US009758884B2

(12) United States Patent
Hingley et al.

(10) Patent No.: US 9,758,884 B2
(45) Date of Patent: Sep. 12, 2017

(54) COLOR CONTROL OF TRIVALENT CHROMIUM DEPOSITS

(76) Inventors: Stacey Hingley, Brierly Hill (GB); Richard Tooth, Solihull (GB); Terence Clarke, Wolverhampton (GB)

( * ) Notice: Subject to any disclaimer, the term of this patent is extended or adjusted under 35 U.S.C. 154(b) by 1369 days.

(21) Appl. No.: 13/398,111

(22) Filed: Feb. 16, 2012

(65) Prior Publication Data

US 2013/0213813 A1 Aug. 22, 2013

(51) Int. Cl.
*C25D 3/06* (2006.01)
*C25D 21/12* (2006.01)

(52) U.S. Cl.
CPC ..... *C25D 3/06* (2013.01); *C25D 21/12* (2013.01)

(58) Field of Classification Search
None
See application file for complete search history.

(56) References Cited

U.S. PATENT DOCUMENTS

| | | | | |
|---|---|---|---|---|
| 4,288,160 | A * | 9/1981 | Lodzinski | 356/73 |
| 4,473,448 | A * | 9/1984 | Deeman | 205/287 |
| 4,804,446 | A | 2/1989 | Lashmore et al. | |
| 5,196,109 | A | 3/1993 | Scott | |
| 5,641,578 | A | 6/1997 | Yoshimi et al. | |
| 7,029,541 | B2 | 4/2006 | Diaddario, Jr. | |
| 2002/0010556 | A1 | 1/2002 | Marapane et al. | |
| 2004/0156999 | A1 | 8/2004 | Biddulph et al. | |
| 2004/0190768 | A1 | 9/2004 | Nonogaki et al. | |
| 2005/0128484 | A1 | 6/2005 | Rodrigues et al. | |
| 2007/0227895 | A1 | 10/2007 | Bishop et al. | |
| 2008/0199721 | A1 | 8/2008 | Scott et al. | |
| 2008/0274373 | A1* | 11/2008 | Takahashi | 428/666 |
| 2009/0008259 | A1 | 1/2009 | Chan | |
| 2010/0050903 | A1 | 3/2010 | Mronga et al. | |
| 2010/0252446 | A1 | 10/2010 | Kuzmanovic et al. | |
| 2011/0128558 | A1 | 6/2011 | Stevens et al. | |
| 2011/0155286 | A1 | 6/2011 | Sugiura et al. | |

FOREIGN PATENT DOCUMENTS

| | | |
|---|---|---|
| WO | 2012/150198 | 11/2012 |

* cited by examiner

*Primary Examiner* — James Lin
*Assistant Examiner* — Ho-Sung Chung
(74) *Attorney, Agent, or Firm* — Carmody Torrance Sandak & Hennessey LLP

(57) ABSTRACT

A method of adjusting and controlling the color of trivalent chromium deposits is provided. The method includes the steps of: (a) measuring the color of a trivalent chromium deposit standard; (b) adding one or more color enhancing additives to a trivalent chromium electrolyte; (c) contacting the substrate with the trivalent chromium electrolyte containing the one or more color enhancing additives to deposit trivalent chromium on the substrate; (d) measuring the color of the color-enhanced trivalent chromium deposit; (e) comparing the color of the color-enhanced chromium deposit to that of the standard; and (f) if necessary, adjusting the amount of the one or more color enhancing additives added to the trivalent chromium electrolyte if the color of the color-enhanced chromium deposit is outside of a desired optical variation from that of the standard color-enhanced chromium deposit. The color of the trivalent chromium deposit may be measured using a spectrophotometer.

14 Claims, 2 Drawing Sheets

COLOR CONTROL OF TRIVALENT CHROMIUM DEPOSITS

FIELD OF THE INVENTION

The present invention relates generally to a method of adjusting and controlling the color of trivalent chromium deposits.

BACKGROUND OF THE INVENTION

Chromium plating is the coating of choice for many metal finishing applications and demand for chrome's bright and lustrous finish continues to grow. Chromium has withstood competitive challenges from other finishes due to its unmatched aesthetics as well as its superior technical capabilities, including corrosion performance and multi-substrate capability. Chromium is widely used in the metal finishing industry for both decorative and hard chrome plating.

Chromium is traditionally electroplated from electrolytes containing hexavalent chromium, but many attempts over the last fifty years have been made to develop a commercially acceptable process for electroplating chromium using electrolytes containing only trivalent chromium ions. The incentive to use electrolytes containing trivalent chromium salts arises because hexavalent chromium presents serious health and environmental hazards. The waste from a hexavalent chromium based solution creates significant environmental concerns and hexavalent chromium baths require special treatment prior to disposal to comply with regulations. Thus, hexavalent chromium ions and solutions from which hexavalent chromium can be plated have technical limitations including the ever-increasing cost of disposing of plating baths and rinse water.

Trivalent chromium plating solutions have become an increasingly popular alternative in the metal finishing industry to hexavalent chromium plating solutions for a variety of reasons, including increased throwing power, as well as lower toxicity. The total chromium metal concentration used in a trivalent chromium solution is also significantly less than that of a hexavalent plating solution, and this reduction in metal, in addition to a lower viscosity of the solution, leads to less dragout and wastewater treatment. Trivalent chromium baths, as a result of their excellent throwing power, also typically produce less rejects and allow for increased rack densities as compared with hexavalent chromium baths.

The trivalent chromium plating rate and hardness of deposit are also similar to that of hexavalent chromium and trivalent chromium electrolytes also operate in the same temperature range as hexavalent chromium electrolytes. However, trivalent chromium electrolytes tend to be more sensitive to metallic impurities than hexavalent chromium electrolytes. Impurities can be removed by means of ion exchange or by precipitating agents followed by filtration.

The two main bath chemistries for trivalent chromium electrolytes are based on chloride and sulfate. In some instances, sulfate-based systems are more beneficial than chloride-based systems for a variety of reasons. For example, the deposit from a sulfate-based system has a higher purity, which leads to better corrosion protection and a color closer to that of hexavalent chromium. The chemistry of the sulfate-based systems is also less corrosive, which prevents deterioration of the plating environment and component areas.

Historically, the color of trivalent chromium deposits has been darker than that of hexavalent chromium deposits. While this problem has been greatly reduced, there are still some slight color differences between the two finishes. Trivalent chromium deposits are essentially produced in two forms—the first form is that which simulates, as closely as possible, the color of hexavalent chromium, and the second form is that which are specifically designed to give a different color to produce a desired cosmetic finish effect.

In addition, dark trivalent chromium coatings are becoming more popular in the industry. The appearance of a dark and shiny finish that can withstand the testing criteria of hexavalent chromium is desirable for many applications and dark trivalent chromium solutions have been developed that meet both appearance and technical requirements. It is desirous for these solutions to exhibit excellent covering and throwing power, consistent color at a wide range of current densities and the advantage of low-metal operation in comparison to hexavalent chromium.

Color additives can be difficult to analyze and control and thus color consistency can be difficult to achieve. It is desirable to provide a means for analyzing and controlling the color of trivalent chromium deposits to maintain color consistency of the deposits.

SUMMARY OF THE INVENTION

It is an object of the present invention to provide a method of analyzing the color of a trivalent chromium deposit.

It is another object of the present invention to provide a method of controlling the color of the trivalent chromium deposit.

It is still another object of the present invention to provide a method of controlling the addition of various color enhancing additives to the trivalent chromium plating bath.

It is still another object of the present invention to provide a trivalent chromium deposit that has a consistent color.

To that end, in one embodiment, the present invention relates generally to a method of controlling color of a trivalent chromium deposit, the method comprising the steps of:

a) measuring the color of a trivalent chromium deposit standard;
b) adding one or more color enhancing additives to a trivalent chromium electrolyte;
c) contacting a substrate with the trivalent chromium electrolyte containing the one or more color enhancing additives to deposit a color-enhanced trivalent chromium deposit on the substrate;
d) measuring the color of the color-enhanced trivalent chromium deposit;
e) comparing the color of the color-enhanced trivalent chromium deposit to that of the standard; and
f) if necessary, adjusting the amount of the one or more color enhancing additives in the trivalent chromium electrolyte if the color of the color-enhanced trivalent chromium deposit is outside of a desired optical variation from the standard.

In another embodiment, the present invention relates generally to a method of controlling color of a trivalent chromium deposit, the method comprising the steps of:

a) measuring the color of a trivalent chromium deposit standard using a spectrophotometer to determine a first CIELAB L* value;
b) adding one or more color enhancing additives to a trivalent chromium electrolyte;

c) contacting a substrate with the trivalent chromium electrolyte containing the one or more color enhancing additives to deposit a color-enhanced trivalent chromium deposit on the substrate;

d) measuring the color of the color-enhanced trivalent chromium deposit using the spectrophotometer to determine a CIELAB L* value for the color-enhanced trivalent chromium deposit;

e) comparing the CIELAB L* value of the color-enhanced trivalent chromium deposit to the first CIELAB L* value for the standard; and f) if necessary, adjusting the amount of the one or more color enhancing additives in the trivalent chromium electrolyte if the CIELAB L* value of the color-enhanced trivalent chromium deposit is outside of a desired optical variation from the first CIELAB L* value for the standard.

DETAILED DESCRIPTION OF THE PREFERRED EMBODIMENTS

Figure 1:
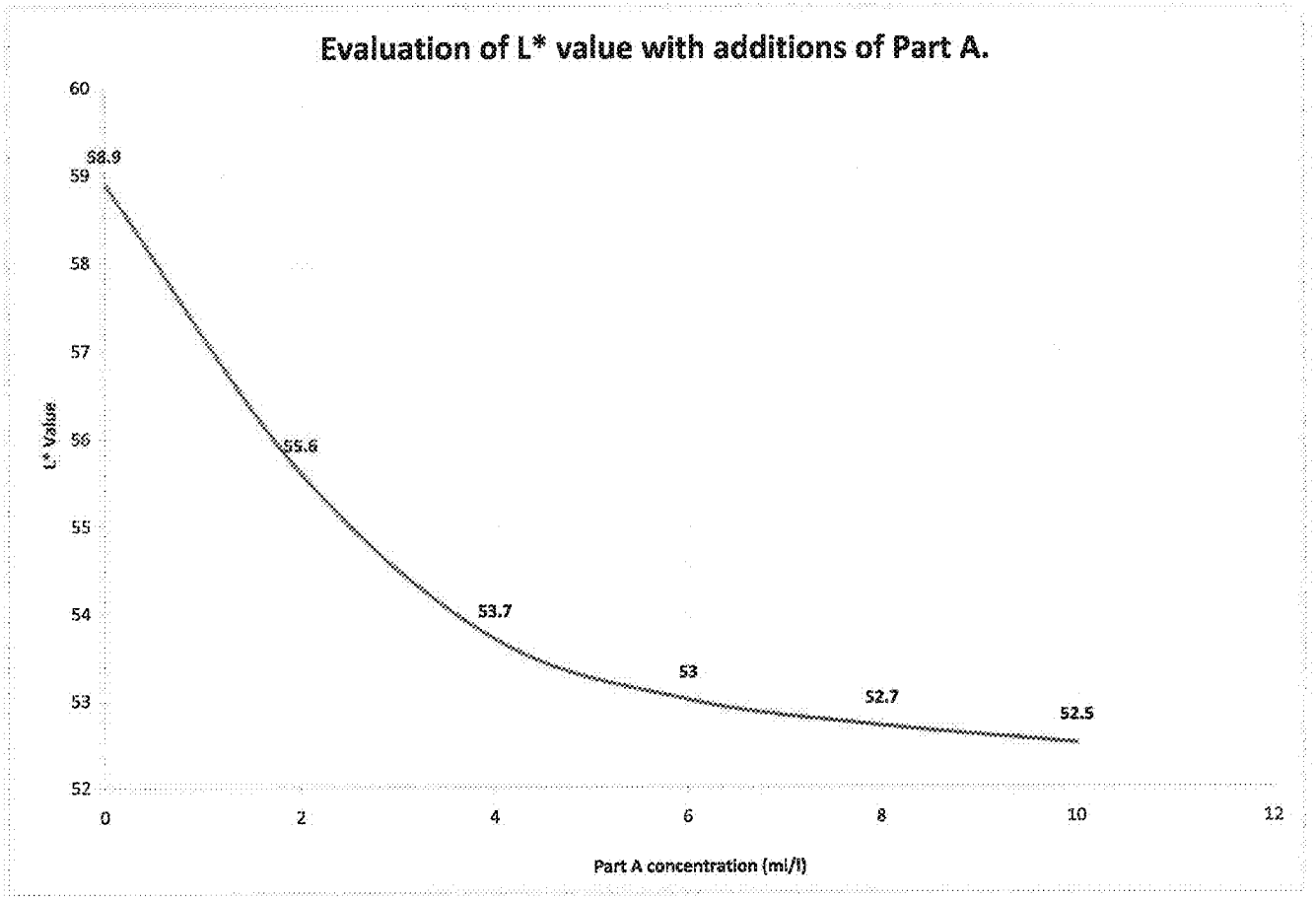
FIG. 1 depicts a graph of L* values of a trivalent chromium deposit with additions of a first color enhancing additive (Part A) to a trivalent chromium electrolyte bath.

The inventors of the present invention have determined that it is possible to predict the amount of various additives required to adjust and control the color of a trivalent chromium deposit. The present invention relates generally to a process of managing the color produced by a trivalent chromium bath using a spectrophotometer and measuring the color of either a standard Hull cell panel or process parts and then accurately adjusting the component chemistry that influences the color range.

In one embodiment, the present invention relates generally to a method of controlling the color of a trivalent chromium deposit, the method comprising the steps of a) measuring the color of a trivalent chromium deposit standard;

b) adding one or more color enhancing additives to a trivalent chromium electrolyte;

c) contacting the substrate with the trivalent chromium electrolyte containing the one or more color enhancing additives to deposit a color-enhanced trivalent chromium deposit on the substrate;

d) measuring the color of the color-enhanced trivalent chromium deposit;

e) comparing the color of the color-enhanced trivalent chromium deposit to that of the standard; and f) if necessary, adjusting the amount of the one or more color enhancing additives in the trivalent chromium electrolyte if the color of the color-enhanced trivalent chromium deposit is outside of a desired optical variation from that of the standard.

As described above, the two main bath chemistries for trivalent chromium baths are based on chloride and sulfate.

A typical chloride-type trivalent chromium electrolyte bath comprises:

| | |
|---|---|
| Trivalent chromium | 15-30 g/l |
| Boric acid (buffer) | 40-80 g/l |
| Sodium, potassium or ammonium chloride | 100-300 g/l |
| Fe (ii)/Fe (iii) | 30-300 mg/l |
| Wetting agent | 0.05-1.0 g/l |
| Complexing agent | 20-50 g/l |

A typical sulfate-type trivalent chromium electrolyte bath comprises:

| | |
|---|---|
| Trivalent chromium | 5-20 g/l |
| Boric acid (buffer) | 50-100 g/l |
| Sodium, potassium or ammonium sulfate | 100-300 g/l |
| Saccharin | 1-5 g/l |
| Catalyst (organic) | 1-5 mg/l |
| Wetting agent | 0.05-1.0 g/l |
| Complexing agent | 5-30 g/l |

Wetting agents are widely used to reduce the surface tension of the solution, which has the effect of minimizing the formation of pores in the deposit. Examples of suitable wetting agents include sodium lauryl sulfate and sodium ethyl hexyl sulfate for sulfate-type chromium electrolyte baths. For chloride-type electrolyte baths, the wetting agent may be a non-sulfur containing non-ionic surfactant such as polyethylene glycol ethers of alkyl phenols, by way of example and not limitation.

A buffer may also be added to maintain the pH of the electrolyte solution at the desired level. Suitable buffers include formic acid, acetic acid and boric acid. In one embodiment, the buffer is boric acid.

In a typical process, a surface to be plated is immersed in the aqueous electrolyte bath containing the trivalent chromium electrolyte and a current is passed through the bath to electrodeposit chromium on the surface.

For all solutions, the physical form of the deposit can be modified or regulated through the addition of leveling agents, which assist in the formation of uniform deposits, or brightening agents, which promote the deposition of bright coatings. Other chemical additions may be required to aid in the dissolving of anodes, and to modify other properties, either of the solution or of the deposit, depending on the specific case. In addition, the solutions may also include complexing agents or conductivity salts.

In addition, chromium electrolyte baths also may comprise one or more additives for color control of the chromium deposit. These one or more additives include silica, sulfur and phosphorus acid, with silica and sulfur being the primary elements for color control. In some bath chemistries, phosphorus acid can also be used to impart extra corrosion performance and also unintentionally darkens the deposit. The inventors have found that deposit color is influenced very little by other bath additives or operating conditions. Contamination by copper and nickel can influence color, but this tends to be current density specific and causes other detrimental effects on performance, including deteriorating the corrosion resistance of the deposit. Thus, it may also be desirable to use ion exchange to manage contamination levels and minimize any color and/or performance impact.

In another embodiment, the present invention relates generally to a method of controlling color of a trivalent chromium deposit, the method comprising the steps of:

a) measuring the color of a trivalent chromium deposit standard using a spectrophotometer to determine a first CIELAB L* value;

b) adding one or more color enhancing additives to a trivalent chromium electrolyte;

c) contacting a substrate with the trivalent chromium electrolyte containing the one or more color enhancing additives to deposit a color-enhanced trivalent chromium deposit on the substrate;

d) measuring the color of the color-enhanced trivalent chromium deposit using the spectrophotometer to determine a second CIELAB L* value of the color-enhanced trivalent chromium deposit;

e) comparing the first CIELAB L* value to the second CIELAB L* value; and f) if necessary, adjusting the amount of the one or more color enhancing additives in the trivalent chromium electrolyte if the second CIELAB L* value of the color-enhanced trivalent chromium deposit is outside of a desired optical variation from the first CIELAB L* value.

CIE L*a*b* (CIELAB) is a color space specified by the International Commission on Illumination and was created to serve as a device independent model to be used as a reference. The L*a*b* color space includes all perceivable colors, and one of the most important attributes of the L*a*b* color space is the device independency, meaning that the colors are independent of their nature of creation.

The three coordinates of CIELAB represent the lightness of the color (L*=0 yields black and L*=100 indicates diffuse white (specular white might be higher)), its position between red/magenta and green (a*, negative values indicate green, while positive values indicate magenta) and its position between yellow and blue (b*, negative values indicate blue and positive values indicate yellow).

The nonlinear relations for L*, a*, and b* are intended to mimic the nonlinear response of the eye. Furthermore, uniform changes of components in the L*a*b* color space aim to correspond to uniform changes in perceived color, so the relative perceptual differences between any two colors in L*a*b* can be approximated by treating each color as a point in a three dimensional space (with the three components L*a*b*) and taking the Euclidean distance between them. The a* and b* axes generally range from −60 to +60.

There are also delta values associated with the CIELAB color scale. ΔL*, Δa*, and Δb* indicate how much a standard and sample different from one another in L*, a* and b*. These delta values are often used for quality control or formula adjustments. Tolerances may also be set for the delta values. Delta values that are out of the tolerances indicate that there is too much difference between the standard and the sample. The total color difference, ΔE* may also be calculated. The ΔE* is a single value which takes into account the differences between the L*, a* and b* of the sample and the standard. It does not indicate which parameter(s) are out of tolerances if the ΔE* is out of tolerance.

As described herein, certain embodiments of the present invention are directed to "dark-colored" chromium deposits. As used herein "dark" or "dark-colored" refers to materials that are black as well as materials having a color approaching black in hue, including, for example, dark grey, dark blue, dark green, dark brown, and the like. In certain embodiments, the dark-colored chromium deposits are capable of producing a coating having a CIELAB L* value of between 60 and 80 depending on the particular composition of the chromium electrolyte and the desired hue of the deposit.

In accordance with the present invention, a user would first make up a trivalent chromium plating electrolyte based on a chloride or sulfate bath chemistry. The user obtains an initial baseline reading of a trivalent chromium deposit with a desired color with a spectrophotometer to determine an initial CIELAB L* value. Next, the user adds the one or more color enhancing additives to the trivalent chromium electrolyte and then obtains a second reading based on a plated trivalent chromium deposit from the electrolyte after the addition of the color enhancing additives to the trivalent chromium electrolyte. Adjustments can then be made to match the standard CIELAB operating range based on the particular bath chemistry. The color readings can thus be maintained within a certain range. For example, the color readings may be maintained within +/−2 ΔE* units, which is considered a reasonable optical variation that is unlikely to be generally observable.

In one embodiment, the one or more additives for color control of the chromium deposit comprise thiocyanate ions and/or nano-colloidal silica. Other sulfur-containing or silica additives or combinations of additives would also be usable in the practice of the invention.

Generally, the CIELAB L* readings are taken for every processed batch of a particular trivalent chromium electrolyte in accordance with the above described procedure until the working range and limitations are established for each plant. Adjustments are then made, using the addition of the color enhancing additives when the readings show a variation close to +/−2 ΔE* units (or another specified variation) from the process standard. Thus, it can be seen that the CIELAB L* values of the trivalent chromium deposit can be obtained for the particular trivalent chromium electrolytic bath and the value can be adjusted by the addition of a specifically determined amount of the color enhancing additive(s) to maintain the CIELAB L* value of the trivalent chromium deposit within a certain range to accurately control and maintain consistency of the trivalent chromium deposit plated from the electrolyte.

Table 1 provides typical CIELAB L* values of the trivalent chromium deposit for various trivalent chromium electrolytic processes as well as CIELAB L* values for a hexavalent chromium deposit.

TABLE 1

Typical CIELAB and ΔE* values for various trivalent chromium electrolytes

| Process | Chemistry | CIELAB L* | Typical +/− 2 ΔE* |
|---|---|---|---|
| TriMacIII ™ | Sulfate | 80 | −0.4, 0.5 |
| Envirochrome | Sulfate | 78 | 0.2, 2.0 |
| TriMac ® | Sulfate | 75 | 0.6, 4.3 |
| Twilite ® | Sulfate | 64 | 0.3, 3.4 |
| Moonlite ® | Chloride | 58 | 0.5, 3.9 |
| MACrome ™ CL3 | Chloride | 75 | 0.2, 2.2 |
| Galaxy | Chloride | 65 | 0.2, 3.8 |
| Onyx | Dark nickel + paint | 62 | 0.5, 5.4 |
| Hexavalent chromium | Sulfate | 85 | −0.9, −1.2 |

(TriMacIII ™, TriMac ®, Twilite ®, Moonlite ®, and MACrome ™ CL3 are all available from MacDermid, Inc., Waterbury, CT).

Example 1

CIELAB L* color readings from standard Hull cell panels were measured and CIELAB L* color readings were related to varying concentration of two different color enhancing additives (Part A and Part B). From this information, it was possible to predict the amount of additive required to adjust and control the color of the deposit.

A composition was prepared in accordance with the Moonlite® process, with the bath Chemistry based on chloride. During the process, CIELAB L* values from standard Hull cell panels were measured and related to varying concentrations of a first color enhancing additive (containing a solution of thiocyanate ions, Part A) and a second color enhancing additive (containing colloidal silica, Part B). From this information, it was possible to predict the amount of additive necessary to adjust and control the color of the deposit.

Figure 2:
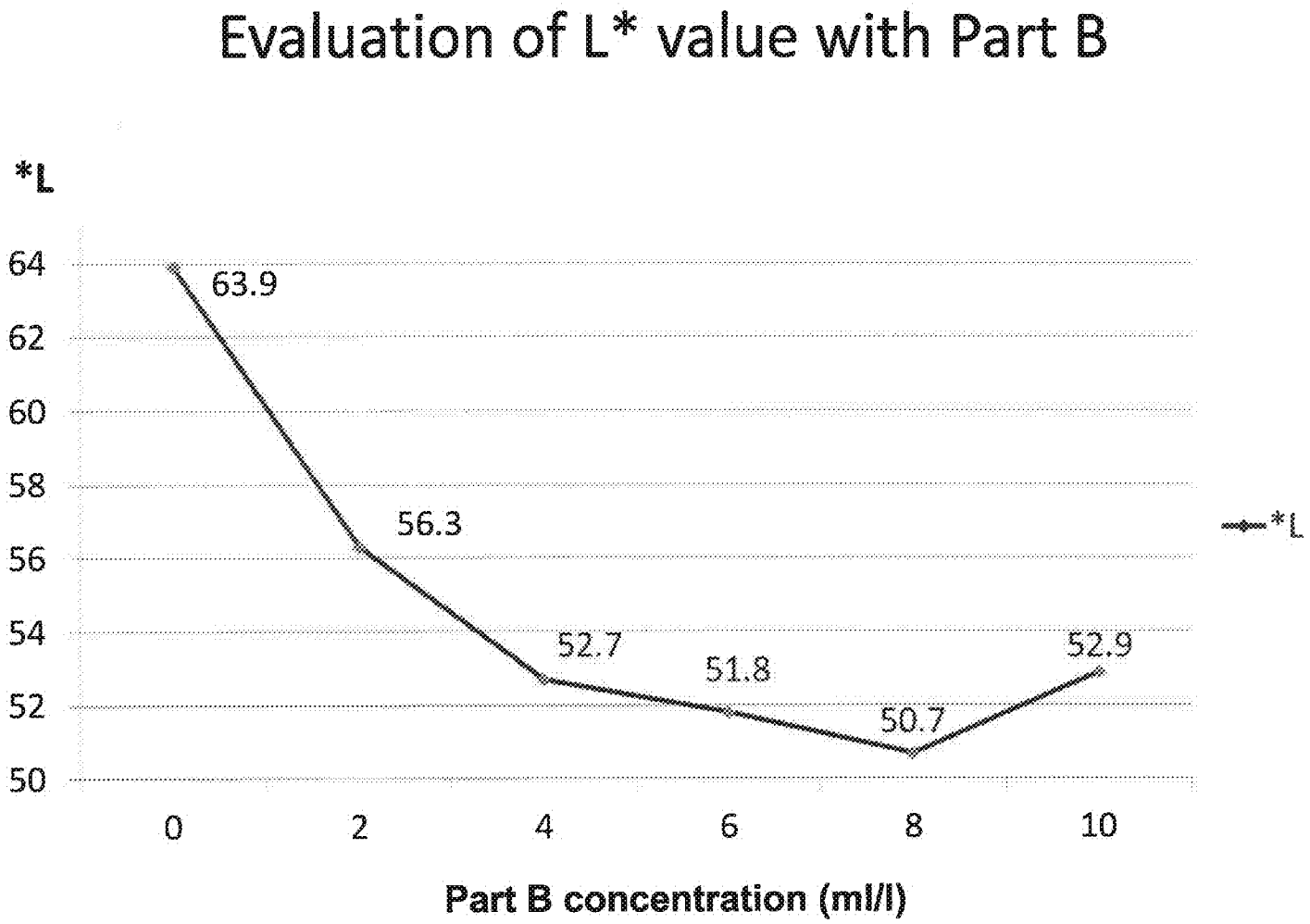
FIG. 2 depicts a graph of L* values of a trivalent chromium deposit with additions of a second color enhancing additive (Part B) to a trivalent chromium electrolyte bath, depicting L* values.

The L* values for Parts A and B are provided below in Tables 2 and 3. In addition, FIG. 1 is a graph demonstrating how the Part A additive influenced deposit color. FIG. 2 is a graph demonstrating how the Part B additive influenced deposition color.

Thus, it can be seen that it is possible to determine L* values for additions of various color enhancing additives and use those values to determine the amount of the color enhancing additive(s) that must be added to the trivalent chromium electrolyte bath to maintain a consistent color of the plating bath and thus the plated chromium deposit.

TABLE 2

| Readings for Part A: | |
|---|---|
| Part A Concentration (ml/l) | L* |
| 0 | 58.9 |
| 2 | 55.6 |
| 4 | 53.7 |
| 6 | 53.0 |
| 8 | 52.7 |
| 10 | 52.5 |

TABLE 3

| Readings for Part B: | |
|---|---|
| Part B Concentration (ml/l) | L* |
| 0 | 63.9 |
| 2 | 56.3 |
| 4 | 52.7 |
| 6 | 51.8 |
| 8 | 50.7 |
| 10 | 52.9 |

Furthermore, while the invention has been described herein in the context of adjusting the color of trivalent chromium deposits, it is also contemplated that the color of other plated deposits could also be adjusted and controlled using the process described herein. Thus, it is contemplated that the present invention can be used to control the color of various electrolytic and electroless plating solutions, where various color enhancing additives are used and tight color control of the plated deposit is desired.

What is claimed is:

1. A method of controlling color of a trivalent chromium deposit, the method comprising the steps of:

a) Measuring the color of a trivalent chromium deposit standard using a spectrophotometer to determine a first CIELAB L* value;

b) Adding one or more color enhancing additive to a trivalent chromium electrolyte;

c) Contacting a substrate with the trivalent chromium electrolyte containing one or more color enhancing additives to deposit a color-enhanced trivalent chromium deposit on the substrate;

d) Measuring the color of the color-enhance trivalent chromium deposit using the spectrophotometer to determine a second CIELAB L* value of the enhanced trivalent chromium deposit;

e) Comparing the first CIELAB L* to the second CIELAB L* value; and f) If necessary, adjusting the amount of one or more color enhancing additives in the trivalent chromium electrolyte if the second CIELAB L* value of the color-enhanced trivalent chromium deposit is outside of a desired optical variation from the first standard CIELAB L* value for the standard.

2. The method according to claim 1, wherein the trivalent chromium electrolyte is based on a chloride or a sulfate bath chemistry.

3. The method according to claim 1, wherein the color enhancing additives are selected from the group consisting of silica, sulfur-containing compounds, phosphorus acid and combinations of one or more of the foregoing.

4. The method according to claim 3, wherein the color enhancing additives comprise at least one of thiocyanate ions and colloidal silica.

5. The method according to claim 1, wherein the optical variation of the CIELAB L* operating range is maintained within +/−2 ΔE* units, by controlling the color enhancing additives in the chromium electrolyte solution.

6. The method according to claim 1, wherein adjustments are made to the trivalent chromium electrolyte using the color enhancing additives when a CIELAB L* value of the color-enhanced trivalent chromium deposit has an optical variation that is more the +/−2 ΔE* units from the standard.

7. The method according to claim 1, wherein the step of contacting the substrate with the trivalent chromium electrolyte containing one or more color enhancing additives comprises immersing the substrate in the color-enhanced chromium electrolyte solution and passing a current through the color enhanced chromium electrolyte solution to electrodeposit chromium on the substrate.

8. A method of controlling the color of a trivalent chromium deposit, the method comprising the steps of:

a) measuring the color of a trivalent chromium deposit standard;

b) adding one or more color enhancing additives to a trivalent chromium electrolyte;

c) contacting a substrate with the trivalent chromium electrolyte containing one or more color enhancing additives to deposit a color-enhanced trivalent chromium deposit on the substrate;

d) measuring the color of the color-enhance trivalent chromium deposit;

e) comparing the color of the color-enhanced trivalent chromium deposit to that of the standard trivalent chromium deposit; and f) if necessary, adjusting the amount of one or more color enhancing additives in the trivalent chromium electrolyte if the color-enhanced trivalent chromium deposit is outside of a desired optical variation from that of the standard trivalent chromium deposit.

9. The method according to claim 8, wherein the trivalent chromium electrolyte is based on a chloride or a sulfate bath chemistry.

10. The method according to claim 8, wherein the color enhancing additives are selected from the group consisting of silica, sulfur-containing compounds, phosphorus acid and combinations of one or more of the foregoing.

11. The method according to claim 10, wherein the color enhancing additives comprise at least one of thiocyanate ions and colloidal silica.

12. The method according to claim 8, wherein the step of contacting the substrate with the trivalent chromium electrolyte containing one or more color enhancing additives comprises immersing the substrate in the color-enhanced chromium electrolyte solution and passing a current through the color enhanced chromium electrolyte solution to electrodeposit chromium on the substrate.

13. A method of controlling the color of a plated metal deposit, the method comprising the steps of:

a) measuring the color of a plated metal deposit standard;

b) adding one or more color enhancing additives to a plating solution;

c) plating a color enhanced metal deposit onto a substrate from the plating solution;

d) measuring the color of the color enhanced metal deposit;

e) comparing the color of the standard to that of the color enhanced metal deposit;

f) if necessary, adjusting the amount of one or more color enhancing additives in the plating solution if the difference between the color of the standard as compared to that of the color enhanced metal deposit exceeds an established maximum deviation.

14. The method according to claim 13, wherein color is determined using a spectrophotometer and is reported in CIELAB L* units.

* * * * *